US006840039B2

(12) United States Patent
Huh

(10) Patent No.: US 6,840,039 B2
(45) Date of Patent: Jan. 11, 2005

(54) EXHAUST MANIFOLD FOR IMPROVEMENT OF PURIFICATION EFFICIENCY AND LIFETIME OF A CATALYTIC CONVERTER

(75) Inventor: Jong-Hoe Huh, Seoul (KR)

(73) Assignee: Hyndai Motor Company, Seoul (KR)

( * ) Notice: Subject to any disclaimer, the term of this patent is extended or adjusted under 35 U.S.C. 154(b) by 0 days.

(21) Appl. No.: 10/306,653

(22) Filed: Nov. 26, 2002

(65) Prior Publication Data

US 2003/0121252 A1 Jul. 3, 2003

(30) Foreign Application Priority Data

Dec. 14, 2001 (KR) ..... 2001-79127

(51) Int. Cl.[7] ..... F01N 7/10
(52) U.S. Cl. ..... 60/323; 60/324
(58) Field of Search ..... 60/299, 302, 313, 60/323, 324

(56) References Cited

U.S. PATENT DOCUMENTS 4,151,716 A * 5/1979 Sakurai et al. ..... 60/282
4,151,717 A * 5/1979 Katsumoto et al. ..... 60/302
4,420,933 A * 12/1983 Kajitani et al. ..... 60/302
6,324,839 B1 * 12/2001 Canini et al. ..... 60/323

FOREIGN PATENT DOCUMENTS

| | | |
|---|---|---|
| JP | 62-153569 | 9/1987 |
| JP | 09-025841 | 1/1997 |
| JP | 10-089055 | 4/1998 |
| JP | 11-294157 | 10/1999 |

* cited by examiner

*Primary Examiner*—Thomas Denion
*Assistant Examiner*—Diem Tran
(74) *Attorney, Agent, or Firm*—Morgan Lewis & Bockius LLP

(57) ABSTRACT

An exhaust manifold is disclosed that enhances the purification efficiency and lifetime of the catalyst in a catalytic converter. The manifold includes: a mixing chamber of a spheroidal shape having runners, each runner having one end connected to an exhaust port and the other end to the mixing chamber along the outer circumference thereof at an angle that causes rotation of the entering exhaust; and a diffuser to induce exhaust gas to diffuse widely before passing through the catalytic converter.

6 Claims, 3 Drawing Sheets

EXHAUST MANIFOLD FOR IMPROVEMENT OF PURIFICATION EFFICIENCY AND LIFETIME OF A CATALYTIC CONVERTER

FIELD OF THE INVENTION

The present invention relates to an exhaust manifold for an engine and, more particularly, to an exhaust manifold that improves the purification efficiency and lifetime of a catalytic converter.

BACKGROUND OF THE INVENTION

A single-cylinder engine has no exhaust manifold and the exhaust pipe is directly connected to a cylinder head. A multi-cylinder engine uses an exhaust manifold to collect the exhaust gas discharged from each cylinder and convey it to an exhaust pipe.

The exhaust manifold has a structure similar to an intake manifold. There are many types, one of which brings the exhaust gas to the center of the exhaust manifold, while another sends it to one end of the exhaust manifold. Some engines having six or more cylinders divide the number of cylinders by two and use two exhaust manifolds, but regardless, the manifolds are designed to minimize the flow resistance and interference of the exhaust gas.

In addition to collecting the exhaust gas and sending it to an exhaust pipe, the exhaust manifold also sends the exhaust gas to a catalytic converter. In the converter, HC, CO, and NOx components, which are harmful to the environment, are converted to harmless $H_2O$, $CO_2$, and $N_2$, respectively, through oxidation and reduction reactions.

The conventional exhaust manifolds, however, has problems because the exhaust gas collected from each runner is generally not uniformly distributed across an entire cross section of the catalytic converter. Usually, the exhaust is heavily directed to a limited area of the catalytic converter and the purification efficiency is decreased. Also, this causes the limited area of the catalyst to operate at a higher temperature than other areas, so that the lifetime of the catalytic converter is reduced.

A reason for these problems is that space limitations make it difficult for designers to adjust the path and angle of each runner in such a way that the exhaust gas from each cylinder is uniformly dispersed across the catalyst. One space limitation is the necessity to provide room for fitting the exhaust manifold to the cylinder head during assembly. This requires that the runners are installed leaving a working space for tools. Another limitation is the need to reduce interference between the exhaust manifold and other components in the engine compartment.

SUMMARY OF THE INVENTION

The present invention provides an exhaust manifold that improves the purification efficiency of a catalytic converter and extends the lifetime thereof. An embodiment of the invention collects the exhaust gas discharged from each cylinder and uniformly distributes it across the entire cross section of the catalyst of the catalytic converter. This embodiment of the present invention includes: a mixing chamber of a spheroidal shape having an outlet; runners each having one end connected to the mixing chamber along the outer circumference thereof and the other end connected to an exhaust port of a cylinder; and a diffuser connected to the outlet of the mixing chamber that induces exhaust gas to widely diffuse and to pass to the catalytic converter.

BRIEF DESCRIPTION OF THE DRAWINGS

A preferred embodiment of the present invention will hereinafter be described in detail with reference to the accompanying drawings. The accompanying drawings illustrate a preferred embodiment of the invention, and, together with the description, serve to explain the principles of the invention, in which.

Like numerals refer to similar elements throughout the several drawings.

DETAILED DESCRIPTION OF THE PREFERRED EMBODIMENTS

Figure 1:
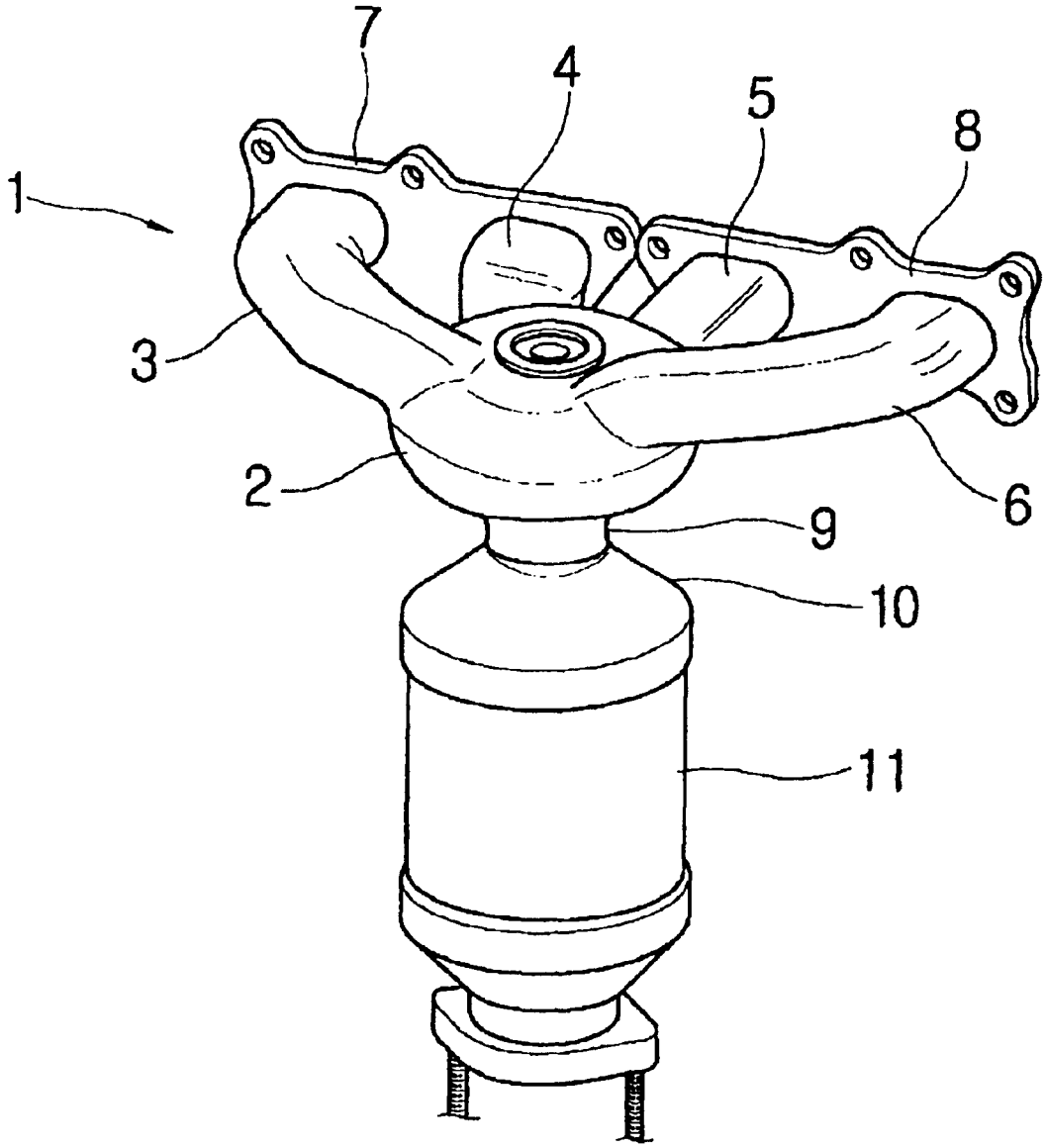
FIG. 1 is an exterior perspective view of an exhaust manifold and catalytic converter according to an embodiment of the present invention.

In FIG. 1, an exhaust manifold according to a preferred embodiment of the present invention is generally designated with reference number 1. The exhaust manifold 1 is provided with a mixing chamber 2 of a spheroidal shape having a larger width (for example, diameter) than height. One end of each runner 3, 4, 5, and 6 is connected to the mixing chamber 2 along the outer circumference thereof. The other ends of the runners 3 and 4 are connected to cylinder exhaust ports through a flange 7, while the other ends of runners 5 and 6 are connected to cylinder exhaust ports through a flange 8. Each runner 3, 4, 5, and 6 is connected to the mixing chamber 2 in a direction that is not perpendicular to the outer circumference of the mixing chamber 2. In a preferred embodiment of the invention these angles are oblique. And 28 degrees from a tangent to the circumference of the mixing chamber 2 is a preferred oblique angle.

A diffuser 10, with an inlet portion 9 that has a smaller width than the mixing chamber 2, is connected at its inlet portion 9 to the outlet of the mixing chamber 2. The diffuser 10 is connected to the catalytic converter 11 at its larger end.

Figure 2:
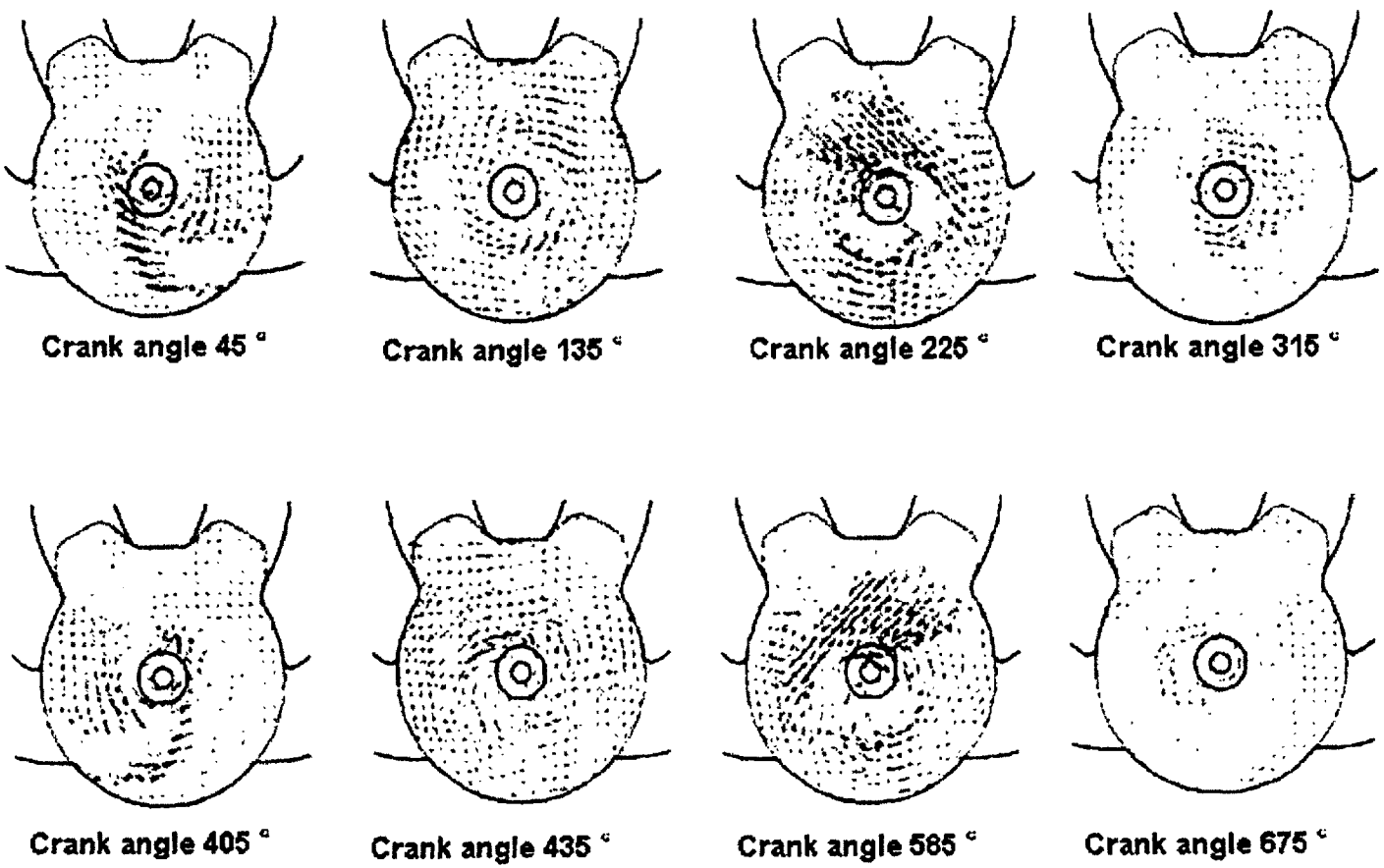
FIG. 2 is a series of diagrams showing flow characteristics of exhaust gas in the mixing chamber at varying crank angles according to a preferred embodiment of the present invention.

The exhaust gas discharged from each cylinder flows into the mixing chamber 2 through the relevant runner 3, 4, 5, or 6. Since each runner 3, 4, 5, and 6 is connected to the mixing chamber 2 in a non-perpendicular direction relative to the outer circumference of the mixing chamber 2, after the exhaust gas flows into the mixing chamber 2 it does not immediately exit the mixing chamber 2 in a linear flow, but rotates within the spheroidal body of the mixing chamber 2, as illustrated in FIG. 2. Note that exhaust from each runner does not cause rotation in the same direction within mixing chamber 2. Runners 3, 4, 5, or 6 may be connected to mixing chamber 2 at any angle that causes sufficient mixing.

Figure 3:
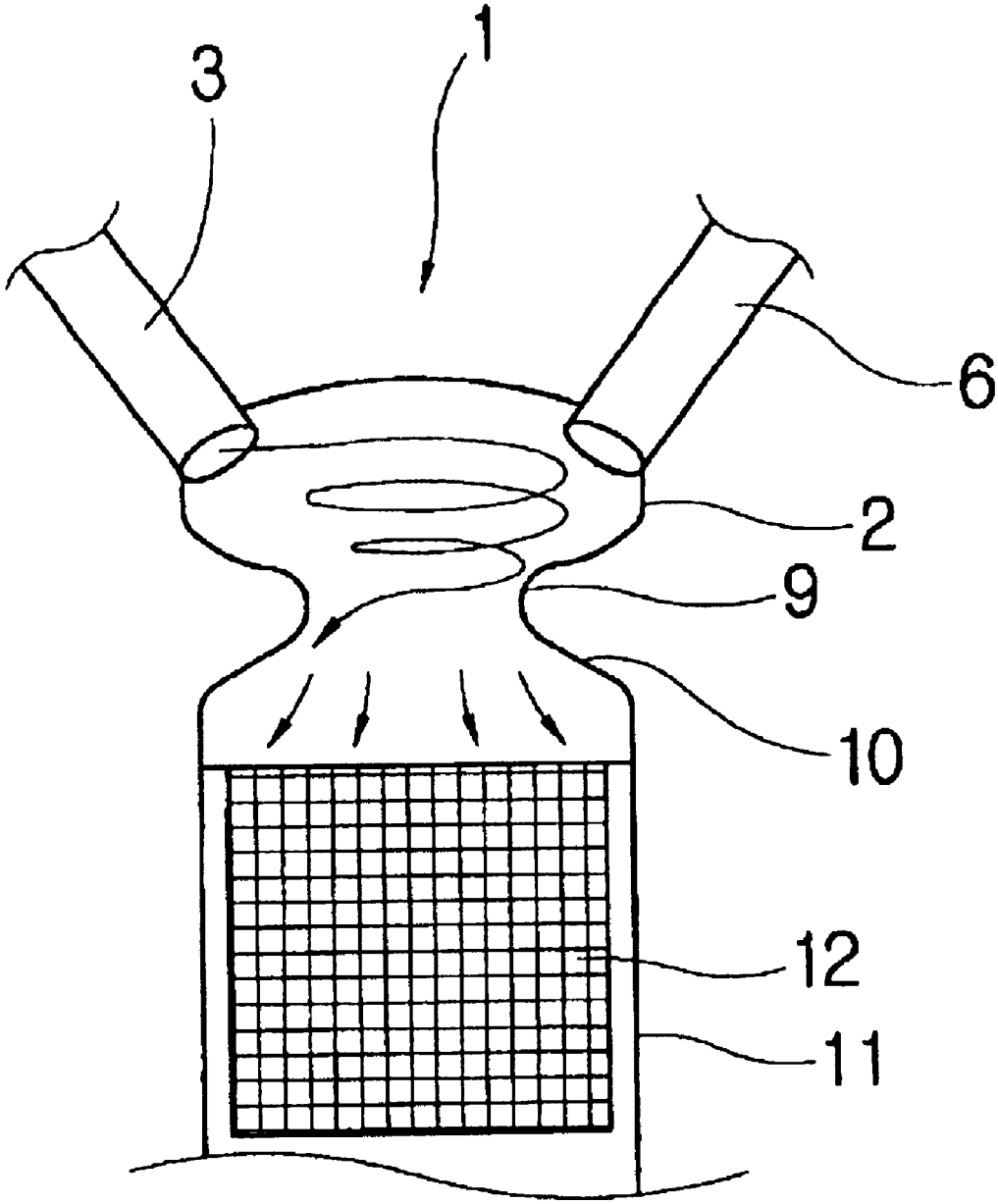
FIG. 3 is a schematic diagram of the diffusion of exhaust gas by an exhaust manifold in a preferred embodiment of the present invention.

The exhaust gas uniformly mixes while rotating within the mixing chamber 2, as illustrated in FIG. 3. When the exhaust gas exits through the narrow inlet portion 9 of the diffuser 10, the flow rate of the exhaust gas is increased, and at the same time, the flow is diffused toward an outer wall thereof along the gradually increasing width due to action of centrifugal force. Thus, the exhaust gas is uniformly distributed across the entire area of a catalyst 12 of the catalytic converter 11.

In the present invention, the exhaust gas flowing into the mixing chamber through each runner is uniformly mixed and distributed while rotating in the spheroidal body of the mixing chamber 2. This causes the exhaust from each runner to expand within the mixing chamber, dispersing the exhaust and distributing the heat from the exhaust more evenly. In the diffuser the exhaust is spread further by centrifugal force and the expansion associated with the increased flow rate. As a result, the phenomenon in which the exhaust gas is concentrated at a certain portion of the catalyst is eliminated, the exhaust gas being relatively uniformly distributed across the entire section of the catalyst. This improves the purification efficiency of the catalytic converter. The lifetime is also improved because the degradation of the catalyst is prevented. It is to be understood that the invention is not limited to the disclosed embodiments, but, is intended to cover various modifications and equivalent arrangements included within the spirit and scope of the appended claims.

What is claimed is:

1. An exhaust manifold, comprising:

a mixing chamber of a spheroidal shape having a larger width than height and having an outlet;

a plurality of runners each having one end connected to said mixing chamber along the outer circumference thereof and the other end configured to be connected to an exhaust port of a cylinder;

wherein each of said runners is connected to said mixing chamber in a direction substantially tangential to the outer circumference of said mixing chamber; and a diffuser connected to said outlet of said mixing chamber that induces exhaust gas to widely diffuse and to pass to a catalytic converter, wherein said diffuser has an inlet portion having a smaller width than that of said mixing chamber, said width gradually increasing nearing said catalytic converter.

2. The exhaust manifold of claim 1, wherein said catalytic converter is connected directly to said diffuser.

3. An exhaust manifold, comprising:

a plurality of runners for conveying exhaust from an engine;

a mixing chamber, wherein each said runner is attached to said mixing chamber and said runners are attached at angles that causes said exhaust to mix within said chamber;

wherein said angles further cause said exhaust to rotate within said mixing chamber, said angles being approximately twenty eight degrees; and a diffuser, said diffuser being configured to evenly distribute said exhaust across an entrance to a catalytic coverter;

wherein a first end of said diffuser couples with said mixing chamber and a second end of said diffuser couples with said catalytic converter, and wherein said diffuser further comprises a tapered portion increasing an inner cross-sectional diameter between said mixing chamber and said catalytic converter.

4. The exhaust manifold of claim 3, wherein said mixing chamber is spheroidal.

5. The exhaust manifold of claim 3, wherein said diffuser is relatively narrow where said mixed exhaust enters said diffuser and is relatively wide where said exhaust leaves said diffuser.

6. An exhaust manifold, comprising:

a mixing chamber having-a spheroidal shape with a larger diameter than height and wherein said mixing chamber has an outlet portion;

a plurality of runners, each runner having a first end coupled with an exhaust port of a cylinder and a second end coupled with said mixing chamber;

wherein said runners couple substantially tangentially with said mixing chamber such that exhaust gasses entering said mixing chamber from each said runner rotate within said mixing chamber and wherein each said runner enters said mixing chamber in a different orientation with respect to said mixing chamber such that said exhaust gasses from each said runner enters said mixing chamber in a different direction; and a diffuser connected to said outlet portion of said mixing chamber;

wherein an inner diameter of said diffuser tapers in size from a first diameter near said mixing chamber outlet to a larger second diameter near a catalytic converter.

* * * * *